US006167717B1

(12) United States Patent
Dudley et al.

(10) Patent No.: US 6,167,717 B1
(45) Date of Patent: Jan. 2, 2001

(54) AIR CONDITIONING CONDENSATION DRAINAGE SYSTEM

(75) Inventors: William E. Dudley, Weimer; C. Ross Dutton, Friendswood, both of TX (US)

(73) Assignee: Sackit, Inc., Houston, TX (US)

( * ) Notice: Under 35 U.S.C. 154(b), the term of this patent shall be extended for 0 days.

(21) Appl. No.: 09/451,791

(22) Filed: Dec. 1, 1999

Related U.S. Application Data

(60) Provisional application No. 60/110,649, filed on Dec. 3, 1998.

(51) Int. Cl.[7] ..... F25D 21/14

(52) U.S. Cl. ..... 62/291; 62/288; 62/289; 62/298; 62/259.1; 62/DIG. 16

(58) Field of Search ..... 62/291, 288, 289, 62/285, 298, 259.1, DIG. 16

(56) References Cited

U.S. PATENT DOCUMENTS

| | | | | |
|---|---|---|---|---|
| 2,886,956 | | 5/1959 | Loveley . | |
| 4,248,258 | | 2/1981 | Devitt et al. . | |
| 4,471,633 | * | 9/1984 | Tinsler | 62/298 X |
| 5,029,452 | * | 7/1991 | Mourabet et al. | 62/298 |
| 5,697,227 | | 12/1997 | Bruce et al. . | |
| 5,938,933 | * | 8/1999 | Williams et al. . | |

* cited by examiner

*Primary Examiner*—William Doerrler
*Assistant Examiner*—Chen-Wen Jiang
(74) *Attorney, Agent, or Firm*—James L. Jackson; Mayor, Day, Caldwell & Keeton L.L.P.

(57) ABSTRACT

An air-conditioning condensate drainage system for mounting to the roof membrane of the roof structure of buildings or for constructing directly onto the roof membrane of a building structure. The air-conditioning condensate drainage system has an isolation membrane having a bottom surface for assembly to a roof membrane. A pair of ridge structures are disposed in fixed relation with the isolation membrane and are disposed in spaced relation with one another and cooperate with the isolation membrane to define an air-conditioning condensate drainage channel between the spaced ridge structures. Each of the ridge structures has one or more ridge defining elements which is fixed to the isolation membrane and projects above the isolation membrane sufficiently to define a condensate drain channel therebetween. One or more upper membranes may be disposed in covering relation with the ridge defining elements and are conformed to suitable configuration by the ridge forming structures to define spaced condensate containment ridges. The upper membranes are also fixed to the upper surface of the isolation membrane to form an integral condensate drainage unit to conduct a/c drainage from a/c units to an in-roof mounted drain.

19 Claims, 5 Drawing Sheets

AIR CONDITIONING CONDENSATION DRAINAGE SYSTEM

The benefit of U.S. Provisional Application Ser. No. 60/110,649, filed on Dec. 3, 1998 by William E. Dudley and C. Ross Dutton and entitled Air Conditioning Condensation Drainage System is hereby claimed for all purposes and is incorporated by reference herein.

BACKGROUND OF THE INVENTION

1. Field of the Invention

The present invention relates generally to the compromise or deterioration of roofing membrane materials by the condensate from air conditioning systems that are mounted on or above the roofs of commercial buildings having what is typically referred to as a "flat roof". More particularly, the present invention concerns the provision of a roof mounted drain system for collecting air conditioning condensate and conducting it to a disposal drain and simultaneously isolating the roof membrane from contact by the air conditioning condensate. Even more specifically, the present invention concerns structure and materials for creating an nondestructive path over the surface of a roofing system, that will direct discharged air conditioning condensate from roof mounted air conditioning units to one or more in-roof drains or gutters for disposal and will serve to isolate the roof membrane from the condensate.

2. Description of the Prior Art

Roofing membrane deterioration is typically caused by the presence of persistent air conditioning ("a/c") condensation in localized areas on a roof surface, regardless of the roof surface membrane or construction. It has been determined through tests that a/c condensation moisture is laden with various chemical constituents and heavy metal concentration. Moreover, as water evaporation occurs and a/c condensation continues to be added onto the roofing membrane, the concentration of chemicals and heavy metals will continuously increase thus increasing the detrimental effect of these materials to the roofing membrane. Particularly, a/c condensation fluids attack the roof membrane in areas where it flows and in collection areas where it tends to collect in pools on the roof membrane surface. It has been found that summer heat will actually turn the water flows and pools into boiling water which will literally oxidize the roofing membrane. Extreme cold will freeze these water flows and pools causing fissures in the roof membrane surface. This problem is well documented by the National Roofing Contractors Association, manufacturers of roofing materials, and other roofing industry experts. Present methods of removing the a/c condensation from the roof surface are not effective. The following is a brief description of the most commonly utilized methods for a/c condensation removal from roofing systems.

PVC or Metal Piping

The most common method utilized for the collecting and removal of a/c condensation from a roofing system is to connect a form of piping to the a/c unit and to run the piping from the unit to a suitable point of drainage. Typically, condensate collected in the condensate collection pan of a/c unit will exit the collection pan at a discharge opening and will flow into a drain line through a water trap, also referred to as a "P-trap". The P-trap is a U-shaped conduit section maintaining a water seal between the collection pan and the drain line which functions to isolate air within the drain line from the interior of the a/c unit Debris and algae will build up or become deposited within the P-trap as well as the drain line and will block the flow of condensate discharge from the collection pan. When a/c condensate drainage piping is utilized, the different types of drainage piping will vary from polyvinyl chloride (PVC) piping, galvanized steel piping, copper piping, and even black iron gas line piping. It has been found with condensate drainage piping that the piping systems quickly become clogged with debris and algae that is present within the drainage system, especially when the a/c unit is situated in a humid environment. It is not unusual for P-traps and drain lines to require service three to four times per year to remove algae and debris blockage Obviously, when a/c drain conduits become clogged to the point that condensate water cannot flow freely therethrough, the condensate will build up within the condensate collection pan until it flows into air flow ductwork and then seeks its way into the building. Service personnel are then called on an emergency basis to prevent leakage of water into the building. At times condensate will build up within the a/c unit until it begins to leak around the edges of the collection pan, in which case it will flow onto the roofing membrane, causing deterioration as mentioned below. If the a/c unit structure is partially rusted away adjacent the perimeter of the condensate collection pan, which is often the case, significant leakage of condensate onto the roofing membrane will occur The condensate will then flow along the roof membrane, following the natural slope of the roof and will develop one or more pools of condensate liquid on the roof surface. This condensate liquid, because it is laden with chemicals and heavy metals as mention above, will begin to degrade the roof membrane. As typically occurs in roofing systems, having condensate drain conduits, because of traffic, age, and constant clogging problems requiring significant maintenance effort and expense, personnel having the responsibility for building maintenance will eventually disconnect the condensate drainage pipes from the air conditioning units. This of course, will cause the a/c condensate to be discharged directly from the collection pan through the drain opening and onto the roof membrane surface. When the drain piping is disconnected in this manner, it is done with the knowledge that deterioration of the roofing membrane by the discharged a/c condensate will eventually result and that as a consequence, roofing repair will be necessitated in a relatively short period of time. The eventual result is that the disconnected a/c drainage pipes will end up as debris that is present on the roof surface. This disconnected piping debris obviously presents a hazard to workers engaged in roofing maintenance and repair and can be a cause of damage to the roofing membrane

Internal Piping

While commercial buildings can be provided with internal a/c drain piping systems that extend throughout the building structure to conventional building drain lines, this method is seldom used. Internal condensate drainage piping is a piping system that is connected with the condensate discharge drains of the various a/c units and extends to plumbing drain lines within the confines of the building structure. Debris collected by the condensate of the a/c units will flow along with the condensate into the drain lines and in time will clog the lines. The algae that builds up in all a/c drain lines also causes clogging of the lines. In a relatively short time the drain lines will be sufficiently blocked that flow of condensate drainage will be blocked. This will cause the a/c condensate to enter duct work and flow into the building structure. These systems are virtually always abandoned due to clogging because the drain lines, being located within the building structure are difficult to access and service or repair.

Surface Drainage

Even though the presence of a/c condensate on a roof membrane is known to cause damage to the roofing system, surface drainage is the method that is most often employed for condensate drainage. Since drainage systems composed of metal or PVC pipe will become clogged and inoperative in a short period of time and are also expensive to install and maintain, it has been found most practical to allow roof surface drainage to occur, knowing that the roofing system will require repair at more frequent intervals. In this case, persistent a/c condensation fluids are allowed to collect in certain areas on the roof membrane surface, causing extensive and accelerated roof membrane deterioration. It is desirable therefore to provide an a/c condensate drainage system for flat roofed building structures which will not be subject to frequent blockage by debris, algae and the like and yet will continuously exclude a/c condensate drainage fluid from the roof membrane surface. It is also desirable to provide flat roofing systems of building structures with a/c condensate drain systems that will efficiently drain a/c condensate fluid along the roof surface to appropriate roof drains for disposal without permitting the a/c condensate to collect on the roof membrane.

Types of Roofing Systems

The following types of roofing systems with roof mounted a/c units are specifically noted as roofing systems that would benefit from installation of an air conditioning condensation drainage system according to the present invention.

Metal Roofing Systems

The term Metal Roof System includes all standing seam, concealed fastener, sheet metal with exposed fasteners, and/or any the of metal roofing system that utilizes metal/panel type construction.

Single Ply Roofing Systems

This type of roofing system includes all single ply systems such as ethylene propylene diene monomer or ethylene propylene diene terpolymer (EPDM), polyvinyl chloride (PVC), chlorosulfonated polyethylene (CSPE), also referred to by its registered trademark HYPALON®, thermoplastic olefin (TPO), and/or other types of single ply roofing membranes of chemically or heat welded seam systems.

Modified Bitumen Roofing Systems

Modified bitumen roofing systems include all types of roofing systems that have a styrene butadiene styrene (SBS) or atactic polypropylene (APP) modified bitumen surface layer.

Built-up Roofing Systems

Built-up roofing (BUR) systems include all types of coal tar and asphalt built-up roofing systems that utilize felts or other fabrics as interply sheets that represent integral components of construction.

Other Roofing Systems

All other types of roofing systems include any roofing system that has a smooth surface of material or materials that define a roofing membrane and is used for water proofing.

SUMMARY OF THE INVENTION

It is a principal feature of the present invention to provide a novel a/c condensate drainage system for the roofing systems of buildings which provides for a/c condensate drainage along the contour of the surface of the roofing membrane and yet isolates the roofing membrane from continuous exposure to the condensate fluid and the chemical and heavy metal constituents contained therein;

It is another feature of the present invention to provide a novel a/c condensate drainage system for the roofing systems of buildings which can be provided in the form of a strip structure or can be installed directly on the roof membrane surface to provide an open roof mounted surface drainage channel to conduct a/c condensate directly from an a/c unit to a roof mounted water drain of the roof structure;

It is an even further feature of the present invention to provide a novel a/c condensate drainage system for the roofing systems of buildings wherein the drainage system is constructed of similar or identical roof membrane materials as compared to the roof membrane structure so that the surface mounted a/c condensate drainage system will be of sacrificial nature, being replaced as needed to permit the roofing membrane to have a normal service life of the roof membrane of the roofing system;

It is an even feature of the present invention to provide a novel a/c condensate drainage system for the roofing systems of buildings which is designed to create a non destructive path over the surface of a roofing system and will direct the discharge condensation from roof mounted a/c units into an in-roof drain or gutter that is constructed from any of a number of existing roofing materials such as bitumen, rubber, CSPE, PVC, foam, TPO, asphaltic, HYPALON®, and/or any other common or uncommon materials used in the roofing industry; and It is another feature of the present invention to provide a novel a/c condensate drainage system for the roofing systems of buildings which includes the use of pre-manufactured surface drainage system materials that are designed for installation onto a roof membrane to create a non destructive path over the surface of a roofing system and will direct the discharge condensation from roof mounted a/c units to an in-roof drain or gutter.

Briefly, the various objects and features of the present invention are realized through the provision of an a/c condensate drainage system having an isolation membrane which is applied to roof membrane surface by heat welding, bonding or by any other suitable means that is common the roofing industry. This isolation membrane will have contact with a/c condensate on a continuous basis and will form the bottom surface of a roof mounted drain channel for conducting a/c condensate along the roof surface to an appropriate in-roof drain. One of the principal functions of this isolation membrane is to ensure that the a/c condensate does not come into contact with the roofing membrane over which it flows. A pair of lateral ridge structures are fixed to the upper surface of the isolation membrane and are disposed in spaced relation so as to define a condensate channel there between. The lateral ridge structures define spacing containment walls which are of sufficient height to efficiently drain a/c condensate along the drain channel without allowing it to overflow from the condensate drainage channel and spill onto the roof membrane surface. The lateral ridge structures may be composed of multiple layers of any suitable roofing material if desired. Alternatively, the lateral ridge structures may be formed by certain roofing materials such as asphaltic impregnated board, for example, which is fixed to the isolation membrane and which is then overlaid by one or more layers of roofing membrane material so that the condensate drain channel is defined largely by the upper layer of roofing membrane material and the drain channel defined thereby.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiments of this invention and are therefore not to be considered limiting of its scope, for the invention may admit to other equally effective embodiments.

In the Drawings:

FIG. 1 is an isometric illustration of a part of a product strip representing an a/c condensate drainage system which is constructed in accordance with the principles of the present invention and is shown affixed to the roofing membrane of building structure;

FIG. 2 is a sectional view showing a portion of a roofing membrane and further showing an a/c condensate drainage system constructed in accordance with the principles of the present invention and representing the preferred embodiment being fixed to the roofing membrane;

FIG. 3 is a sectional view similar to that of FIG. 1 and further showing that the lateral ridge structures defining the drain channel can be of differing height if desired;

FIG. 4 is a partial plan view showing a portion of a conventional a/c unit and further showing an a/c condensate drain system of the present invention being utilized for conducting a/c condensate from the a/c unit towards a drain of a building structure;

FIG. 5 is a planned view showing a pair of air conditioning drain channels constructed in accordance with the present invention extending from air conditioning units and intersecting to conduct a/c condensate drainage to a single drain channel similarly constructed;

FIG. 6 is a sectional view showing an alternative embodiment of the present invention wherein a pair of upper membrane elements are disposed in overlying relation with spaced ridge defining elements and are each fixed along edge portions thereof to the isolation membrane;

FIG. 7 is a sectional view of an a/c condensate drainage system constructed in accordance, with the present invention and showing spaced lateral ridge structures thereof being composed of multiple layers of suitable roofing materials assembled to a bottom membrane structure forming the isolation membrane thereof;

FIG. 8 is a diagrammatic illustration of a machine and method for manufacturing air-conditioning condensate drainage assembly and providing it in rolls or strips for use roof installation personnel;

FIG. 9 is a sectional view showing an alternative embodiment of the present invention which may have a monolithic form such as may be defined by an extrusion, a molding or any other suitable manufacturing process;

FIG. 10 is also a cross-sectional view showing another alternative embodiment of the present invention and which is also in the form of a monolithic structure;

Figure 11:
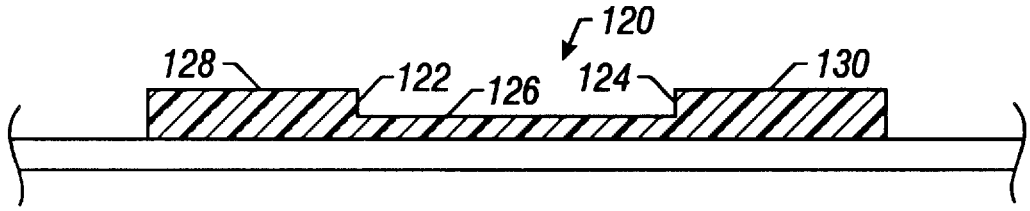
Figure 12:
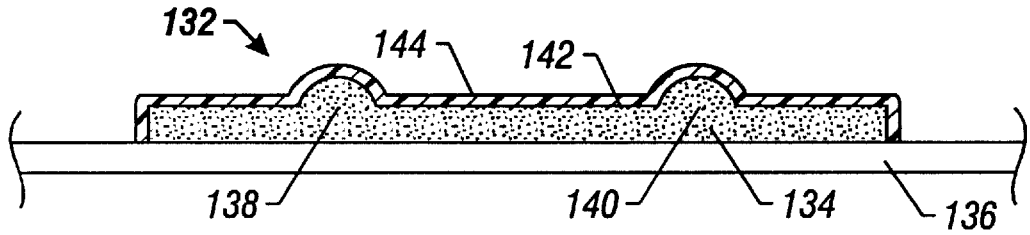

FIG. 11 is a cross-sectional view showing another alternative embodiment of the invention wherein the a/c condensate drainage system is defined by monolithic strips of material of any suitable composition capable of being extruded, molded or fabricated from polymer foam, PVC, modified bitumens, Hypalons, CSPE, EPDM and/or other materials; and FIG. 12 is a cross-sectional illustration of another alternative embodiment of the present invention which is defined by a base of polymer foam or other suitable material which is covered by a layer of acrylic or other suitable material being applied to the base in any suitable manner.

DETAILED DESCRIPTION OF PREFERRED EMBODIMENT

Figure 1:
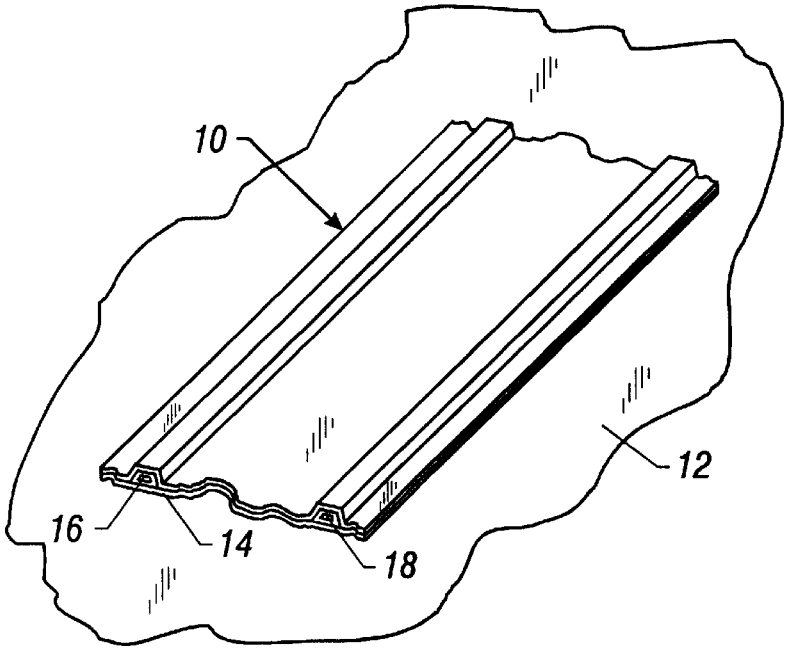

Referring now to the drawings and first to FIG. 1, an air-conditioning condensate drainage system constructed in accordance with the principles of the present invention and representing the preferred embodiment is shown generally at 10 and is shown in the figure as a partial strip of condensate drain structure which is shown to be mounted in any suitable fashion onto the roofing, membrane 12 of a building roofing system. The air-conditioning condensate drainage system of FIG. 2 is a sectional view of the drainage system structure shown in FIG. 1, differing only in the specific cross-sectional geometry of the ridge defining elements as will be explained in detail hereinbelow.

Figure 4:
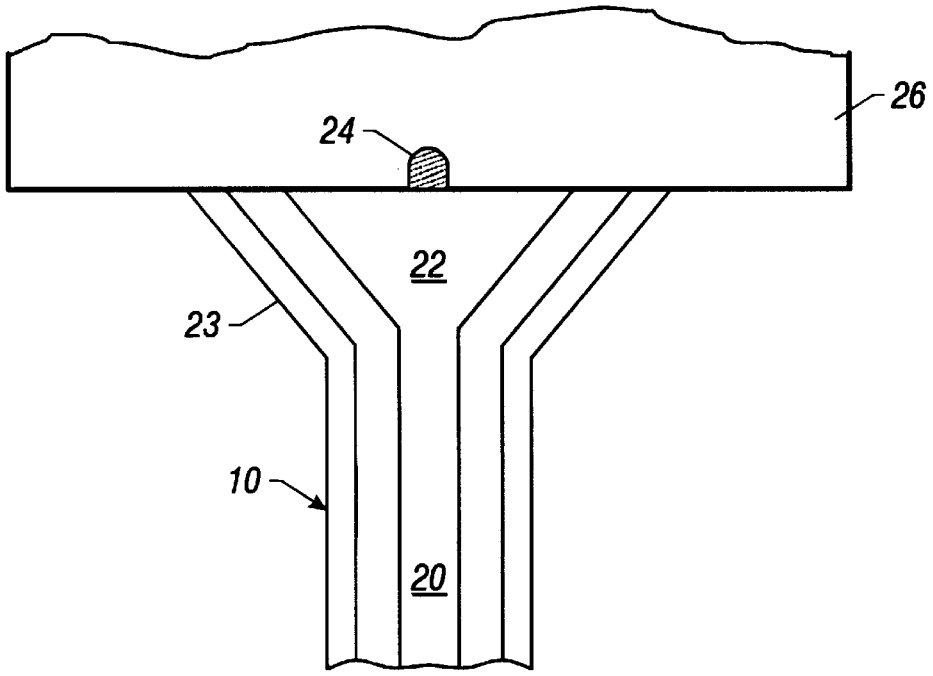
Figure 5:
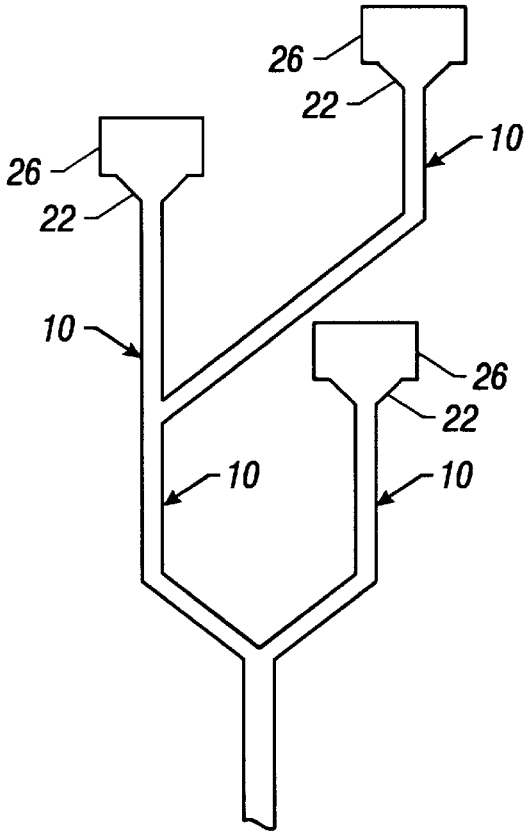

The air-conditioning condensate drainage system 10 comprises an isolation membrane 14 which is typically in the form of an elongate strip of material that is compatible with the membrane material of the roofing membrane 12. Typically, the isolation membrane will be constructed of a polymer material such as polyvinyl chloride (PVC) which may be layered with other suitable materials and may be reinforced by a suitable fabric to enhance the structural integrity thereof. The isolation membrane, however, may be constructed of any other suitable roofing membrane material without departing from the spirit and scope of the present invention. The isolation membrane 14 may be constructed of identical or similar material as compared with the roofing membrane and will be affixed to the upper surface of the roofing membrane 12 by heat welding, bonding, by suitable roofing adhesive or by any other installation method or materials as is common to the roofing industry. The isolation membrane typically serves as the bottom membrane layer or one of the bottom layers of the a/c condensate drainage system and functions to isolate the roofing membrane 12 from contact by a/c condensate and the chemicals and heavy metals present therein and also functions to define the bottom wall structure of a drainage channel for conducting a/c condensate from the condensate discharge of an a/c unit to a suitable drain in the roofing structure. To the isolation membrane is affixed at least a pair of spaced ridge defining elements 16 and 18 which may be unitary members or may be composed of a plurality of strip elements affixed in assembly. The spaced ridge defining elements may be composed of asphaltic impregnated board which is secured to the isolation membrane with MB Gold or with any other suitable bonding agent that is common to the roofing industry. Additionally, the spaced ridge defining elements may be composed of a heat weldable polymer material such as PVC which is, heat welded to the isolation membrane 14 and thus is a permanent integral component of the air-conditioning condensate drainage system. The spaced ridge defining elements are typically oriented in substantially parallel relation so as to define a condensate drain channel 20 therebetween. It should be borne in mind however, that the spaced ridge elements may be oriented in angular relation to one another or oriented in any other suitable relation to define a drainage channel of desired configuration and dimension. For example, as is evident from FIGS. 4 and 5 hereof the spaced ridge defining elements and the resulting ridges defined thereby are oriented in diverging relation so as to define a catch basin 22 for collecting condensate being discharged by a condensate drain opening 24 of an a/c unit 26. Typically, the catch basin 22 will be provided in the form of a pre-manufactured connector structure 23 which is affixed to tie roofing membrane and is also affixed in suitable manner to a strip of pre-manufactured condensate drain assembly 10. Alternatively, a catch basin structure can be constructed in place on the roofing membrane so that its configuration can be suited to the a/c drain and the roof structure of the building. The installed or pre-manufactured connector structure 23 may be of any suitable configuration and may be used for connection of drain channels, for defining catch basins, for connecting drain channels with roof mounted drain fittings, etc, without departing from the spirit and scope of the present invention. It should also be borne in mind that the spaced ridge defining elements may be of any suitable dimension or configuration desired to define spaced ridges having a drain channel therebetween. The spaced ridge defining elements may be of substantially triangular or rhomboid cross-sectional configuration as shown in FIG. 1, of rectangular cross-sectional configuration as shown in FIGS. 2 and 3 or may be of oval or round cross-sectional configuration if desired. In fact, the ridge defining elements may be of any configuration or dimension for defining spaced ridges projecting a suitable height above the isolation membrane to ensure that the maximum expected volume of a/c condensate flow will be accommodated by the drain channel. Additionally, since the roofing membranes of flat roofed commercial buildings typically are slightly sloped to enable surface drainage of the water resulting from rain, melting snow or ice to the in-roof surface drains of the roofing system, the spaced ridges of the condensate drain structure must be of sufficient height to compensate for the slight slope of the roofing membrane and yet provide for adequate containment of the a/c condensate that is intended to be acquired and controlled as it is conducted to a suitable in-roof drain for ultimate disposal. As an example, it should be noted that the ridge defining elements 28 and 30 of the embodiment shown in FIG. 3 are of differing height so that one drain channel ridge will have greater height than the other. This will allow the air-conditioning condensate drainage system to be mounted to a slightly sloping roof membrane in a manner accommodating its slope, and yet ensuring that the a/c condensate is adequately contained and is not permitted to spill onto the roofing membrane surface.

Figure 2:
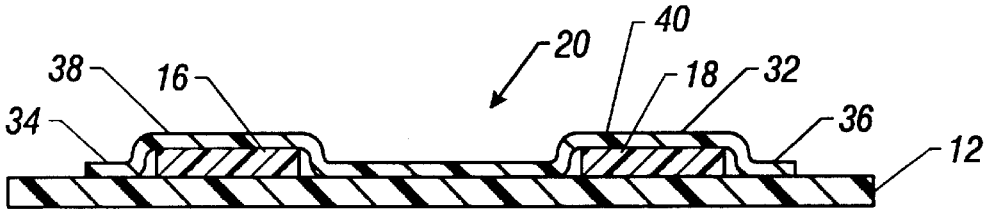
Figure 3:
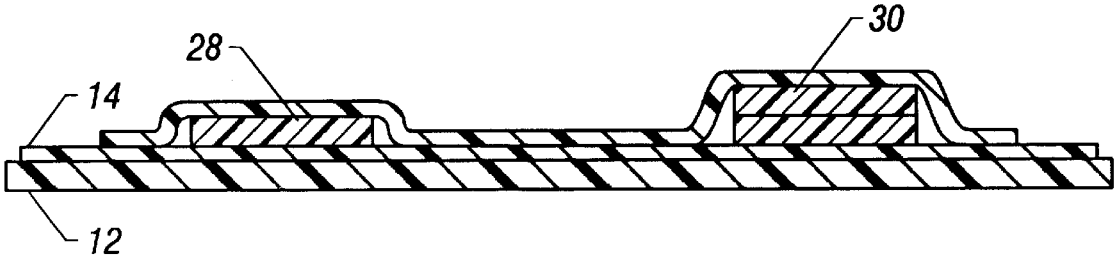

The air-conditioning condensate drainage system shown in the embodiment of FIGS. 1–3 is completed by an upper membrane 32 which is fixed at its edges 34 and 36 to the isolation membrane 14, such as by heat welding, bonding, cementing or by any other suitable means for permanent attachment. The upper membrane is also disposed in overlying relation with and may be suitably fixed to the ridge defining elements 16 and 18 if desired, or my simply overlie the ridge forming element if desired. Thus, the upper membrane will be suitably configured by the ridge defining elements to define spaced water containing ridges 38 and 40 which serve to confine the flow of a/c condensate to the drain channel defined between the spaced ridges. The upper membrane also isolates the ridge defining elements from contact with the condensate and the chemical and heavy metal constituents thereof. The upper membrane 32 will also have a central portion 42 which will typically be affixed to the upper surface of the isolation membrane so that the drain channel of the air-conditioning condensate drainage system will be defined in part by a double layer of suitable membrane material for isolating the roofing membrane from potential contact with the condensate flowing along the drain channel from the a/c units to an in-roof drain of the roofing system.

Figure 6:
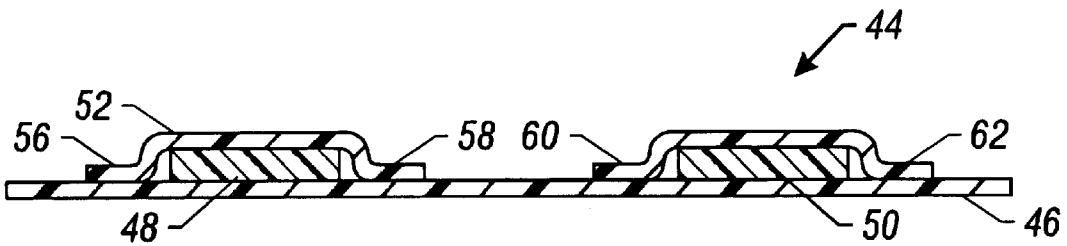

In an alternative embodiment of the present invention, as shown generally at 44 in FIG. 6, an isolation membrane 46 is provided which will be fixed to a roofing membrane in the manner discussed above. Ridge defining elements 48 and 50 are fixed to the upper surface of the isolation membrane and are disposed in spaced relation in the manner indicated above. A pair of ridge membranes 52 and 54 are disposed in covering relation with the ridge defining elements 48 and 50 and define respective side edges 56–58 and 60–62 respectively are heat or chemically welded, bonded, cemented or otherwise fixed in sealed and permanently secured relation to respective areas of the upper surface of the isolation membrane 46. It should be borne in mind that the ridge defining elements 48 and 50, though shown to be of rectangular cross-sectional configuration in FIG. 6, may be of square, triangular, rhomboid, oval or round cross-sectional configuration and may be composed of any suitable material capable of defining water barrier ridge structures, without departing from the spirit and scope of the present invention.

Figure 7:
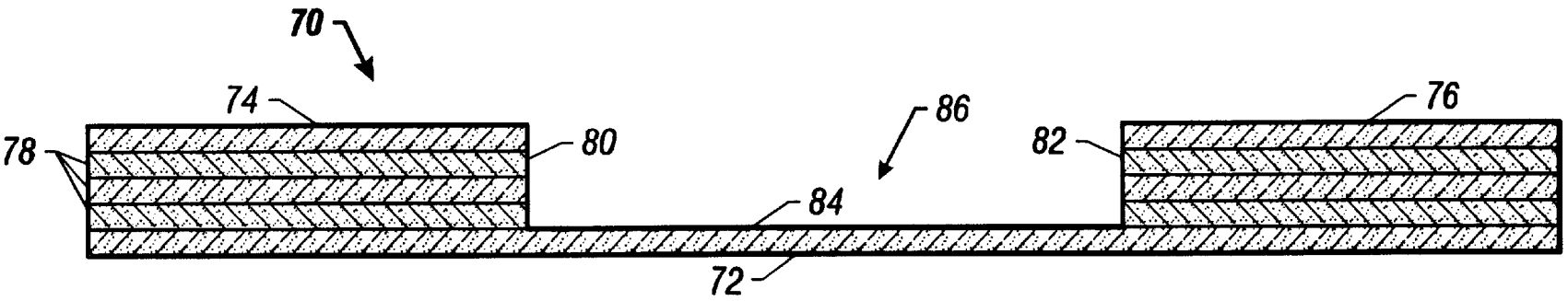

Referring now to FIG. 7, another alternative embodiment of the present invention is illustrated generally at 70 which is constructed in built-up fashion, such as by using multiple layers of smooth surfaced modified bitumen, which is a conventional material for the construction of built-up roofing. The air-conditioning condensate drainage system 70 is provided with an isolation membrane 72 which is intended for fixed attachment to the roof membrane of a building structure. To the isolation membrane is fixed a pair of spaced ridge structures 74 and 76 which are each define by a plurality of layers of built-up roofing material adhered one to the other. Sufficient layers 78 of built-up roofing are added to cause the ridge structures 74 and 76 to project sufficiently above the isolation membrane to compensate for roof slope and to contain the volume of condensate flow that will occur at conditions of maximum flow. The combined layers 78 of built-up roofing material define facing condensate containment walls 80 and 82 that also define drain channel walls which cooperate with the upper surface 84 of the isolation membrane to define a condensate drain channel 86. Though the condensate containment walls are shown to be oriented in substantially normal relation with the isolation membrane, such orientation is not intended as limiting of the spirit and scope of the present invention. For example, the containment walls may be inclined with respect to the vertical if desired.

Figure 8:
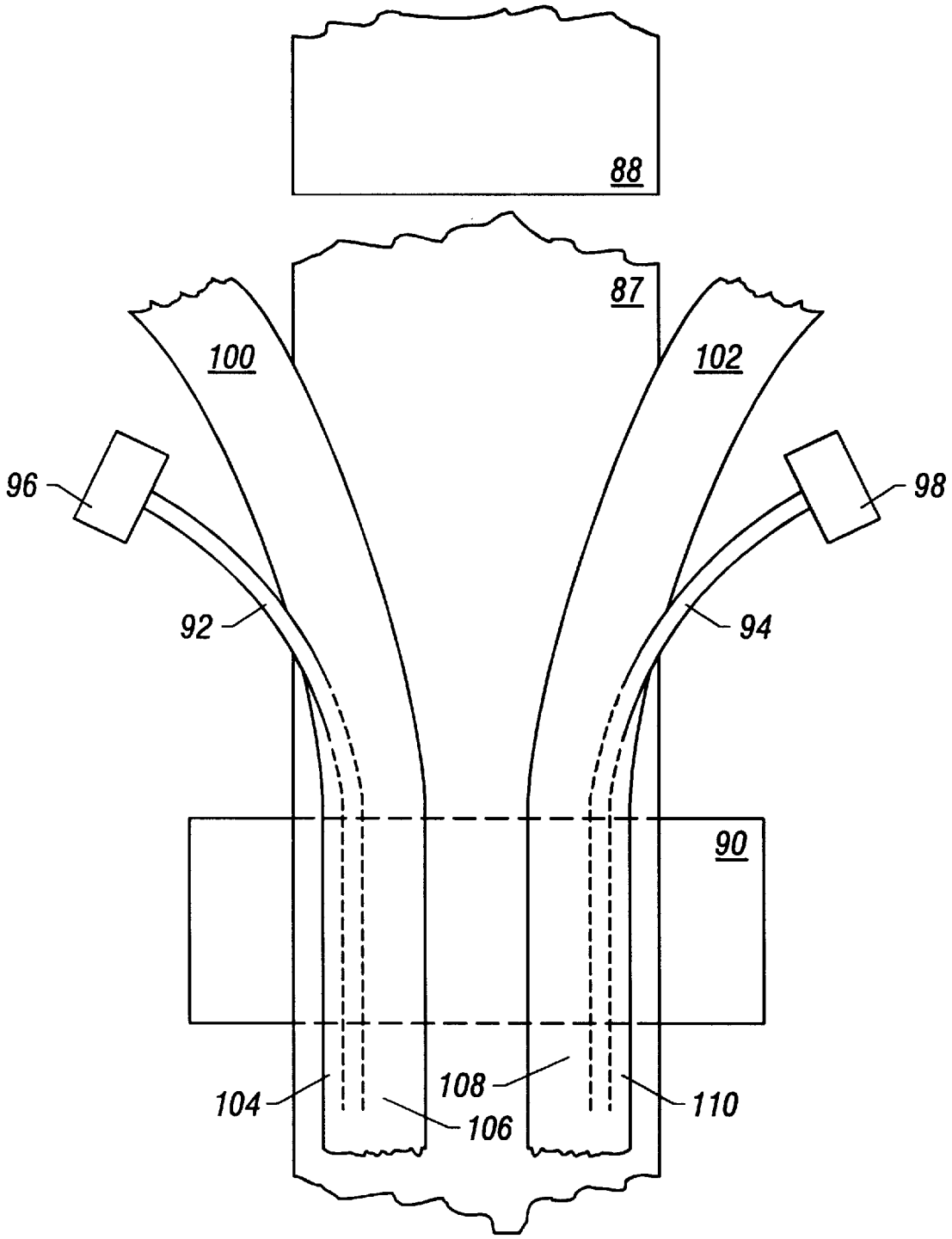

Referring now to FIG. 8, a pre-manufactured air-conditioning condensate drainage system according to the present invention can be manufactured by feeding a strip of polymer isolation material 87 from a supply such as a supply roll 88 passing a strip of polymer isolation membrane material through a heat or chemical welding machine 90. As the polymer isolation membrane material is being passed through the heat or chemical welding machine, ridge forming strips 92 and 94 are also fed in linear fashion from strip supply rolls 96 and 98 into the heat or chemical welding machine and are brought into assembly with the strip of polymer isolation membrane material so that the ridge forming strips are disposed in suitably spaced relation on the isolation membrane. Simultaneously, one or more strips 100 and 102 of upper membrane material are fed into the heat or chemical welding machine 90 and are positioned in overlying relation with the ridge forming strips, and with edge portions 104–106 and 108–110 thereof disposed in face-to-face relation with the strip of polymer isolation membrane material. Simultaneously, the heat or chemical welding machine applies sufficient mechanical pressure, such as by one or more pressure applying rollers to the portions of the upper membrane material and isolation membrane that are in face-to face-relation, thus heat or chemically welding the upper membrane material to the isolation membrane in the regions of face-to-face contact. The resulting heat or chemically welded assembly can then be rolled so that rolls of extended length can be shipped to end users. In the alternative, the heat welded air-conditioning condensate drainage system assembly can be cut into strips of suitable length, i.e., ten foot lengths, twenty foot lengths, etc. and can then be packaged for shipment to wholesalers, retailers or end users.

An alternative manufacturing process is accomplished by placing a suitable length of isolation membrane on a platen and then placing ridge defining elements and one or more strips of upper membrane material of suitable length in assembly on the isolation membrane material and in overlying relation with the ridge defining elements. Heat is then applied to suitable portions of the assembly, typically in the presence of mechanical pressure, to cause efficient heat welding of the assembly and forming of the air-conditioning condensate drain material in integral strip form for subsequent installation on the roofing membrane of roofing systems. If chemical welding is desired or if bonding or cementing is desired, a suitable chemical bonding agent, cement, adhesive or chemical welding material is located at the surface contact interface of the materials to be secured. Additionally, mechanical pressure may also be applied, such as by platens, rollers or the like, to ensure the structural integrity of the material connection.

It is also envisioned that the air-conditioning condensate drainage system may be assembled during its installation on the roof membrane of a roofing system. As is evident from, FIG. 7, the isolation membrane 72 may be installed on a roof membrane in typical fashion, such as by bonding, chemical welding, cementing, etc. Thereafter, layers of built-up roofing material 78 will be applied one on top of the other until spaced ridge structures of suitable height will have been established, essentially as shown in FIG. 7. It should also be born in mind that the drain structure shown in FIGS. 1–6 may also be installed by constructing them directly on the roof structure through the use of any suitable construction procedure and materials that are appropriate to the roofing industry.

As a further example, the air-conditioning condensate drainage system of FIGS. 1–3 can be installed in place on the roof membrane of a roofing system according to the following procedure The isolation membrane 12 can be installed directly onto the roof membrane and suitably oriented to accommodate the slope of the roof membrane. The ridge defining structures may then be placed in suitably spaced relation on the isolation membrane. Thereafter, one or two of the upper membranes can be assembled in overlying relation with the ridge defining structures and with edge portions thereof in face-to-face relation with the isolation membrane. Thereafter, heat can be applied to accomplish heat welding of the edges of the upper membrane or membranes to the isolation membrane, if desired, this heat welding procedure can be enhanced by applying one or more heated platens to suitable surface areas of the upper membrane so that the resulting heat weld is completed by heat and mechanical pressure. The same general procedure may be utilized for chemically welding the materials or by achieving permanent connection of the materials by bonding, cementing or otherwise securing the materials in assembly.

A machine such as shown in FIG. 8 may be utilized for chemical or solvent welding of the membrane components of a roof mounted a/c condensate drain system. Instead of applying heat as indicated above or in addition to application of heat a suitable solvent or cement that is, compatible with the material from which the membranes are composed may be introduced to contacting surfaces of the membranes. Additionally, mechanical pressure can be applied by pressure applying rolls or platens to enhance the chemical or solvent welding, cementing or bonding of the membranes in a manner forming the condensate drain structure disclosed herein. If desired, the roof mounted condensate drain structure of the present invention may be assembled on the roof membrane of the roofing system through the use of chemical or solvent welding or through the use of any of a number of suitable adhesives and cements that are utilized in the roofing industry.

Figure 9:
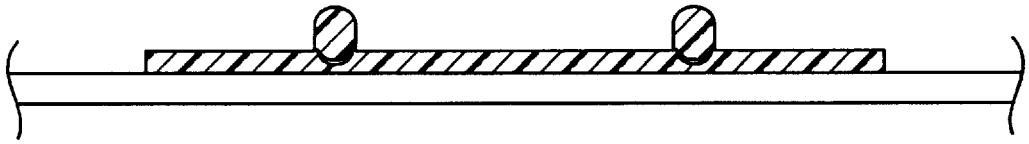
Figure 10:
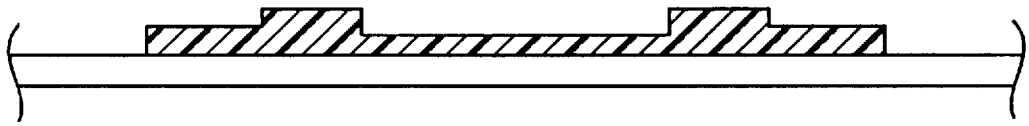

FIGS. 9–11 are cross-sectional illustrations being representative of a/c condensate drainage systems of monolithic construction and which may be formed by extrusion, molding or fabrication. These strip profiles maybe composed of polymer foam material PVC, Modified bitumens, Hypalons, CSPE, EPDM, and/or other suitable materials. In each case the profiles define spaced ridges and a bottom wall to confine a/c condensate and thus prevent its contact with the roof membrane to which the a/c condensate drainage system is affixed. In the embodiment of FIG. 11 the drainage channel 120 is defined by opposed wall surfaces 122 and 124 and by the bottom wall 126 of the monolithic structure. The opposed wall surfaces 122 and 124 are defined by spaced ridge projections 128 and 130.

Referring to FIG. 12, a cross-sectional illustration of a further alternative embodiment is shown generally at 132 in which a base structure 134 may be composed of any of a number of commercially available expandable foam materials which may be formed in place or may be premanufactured and then affixed to a roofing membrane 136 by cementing, bonding or by any other suitable means. The base structure is formed with spaced ridges 138 and 140 which cooperate with a generally planar upwardly facing surface 142 located between the ridges and defining a drainage channel 144. The entire upper surface region of the base structure 134 is shown to be intimately covered by an elastomer protective finishing layer of weather, heavy metal and chemical resistant material such as an acrylic, urethane, epoxy or other suitable material. The elastomer finishing layer may be applied to the base structure by spraying, painting, thermal bonding or welding or by other suitable processes. The elastomer finishing layer may be applied by a suitable manufacturing operation or it may be applied during installation of the a/c condensate drain system to a roofing membrane. For example, the base layer 134 of expandable foam material may be formed directly on the roofing membrane and the elastomeric protective layer 142 may be applied to the expandable foam base to finalize the installation procedure.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. An air-conditioning condensate drainage system for the roof structure of buildings, comprising:

(a) an isolation membrane having a bottom surface for assembly to a roof membrane and having an upper surface;

(b) a pair of ridges being disposed in fixed relation with said isolation membrane and disposed in spaced relation with one another and cooperating with said isolation membrane to define an air-conditioning condensate drainage channel between said ridges.

2. The air-conditioning condensate drainage system of claim 1, comprising:

(a) said pair of ridges each having a ridge defining element; and (b) at least one upper membrane overlying said pair of ridge defining elements and being fixed to said isolation membrane, said at least one upper membrane being suitably configured by said pair of ridge defining elements to define said spaced ridges for confining air-conditioning condensate to said isolation membrane between said spaced ridges.

3. The air-conditioning condensate drainage system of claim 1, comprising:

said ridge and drain channel membrane being fixed to said upper surface of said isolation membrane at least in the region thereof between said spaced ridge defining elements.

4. The air-conditioning condensate drainage system of claim 1, comprising:

a pair of upper membranes respectively overlying said pair of ridge defining elements and being fixed at edge portions thereof to said isolation membrane, said pair of upper membranes being suitably configured by said pair of ridge defining elements to define said spaced ridge structures for confining air-conditioning condensate to said isolation membrane between said spaced ridge defining elements.

5. The air-conditioning condensate drainage system of claim 1, comprising:

said pair or spaced ridges each being formed by multiple layers of built-up roofing material, said multiple layers establishing desired height and configuration of said spaced ridges and defining opposing containment wall configuration of said spaced ridges.

6. The air-conditioning condensate drainage system of claim 5, comprising:

said isolation membrane being formed by a layer of built-up roofing material which is adapted to be fixed to the roof membrane of the roofing system.

7. The air-conditioning condensate drainage system of claim 1, comprising:

(a) an upper membrane being disposed in overlying relation with said pair of spaced ridge defining elements and defining a central portion and edge portions; and (b) said central portion of said upper membrane being fixed to said isolation membrane between said ridge defining elements and said edge portions of said upper membrane being fixed to said isolation membrane outboard of said ridge defining elements.

8. The air-conditioning condensate drainage system of claim 1, comprising:

(a) an upper membrane defining a central portion and edge portions and being disposed in overlying relation with said pair of spaced ridge defining elements, said upper membrane being formed by said ridge defining elements to define said spaced ridges; and (b) said central portion of said upper membrane being fixed to said isolation membrane between said ridge defining elements and said edge portions of said upper membrane being fixed to said ridge defining elements and being fixed to said isolation membrane outboard of said ridge defining elements.

9. An air-conditioning condensate drainage system for the roof structure of buildings, comprising:

(a) an air-conditioning condensate isolation structure having a bottom wall defining a bottom surface for engagement with a roof membrane; and (b) a pair of upwardly facing spaced ridge elements projecting upwardly from said air-conditioning condensate isolation structure and above said bottom wall and defining an air-conditioning condensate drainage channel therebetween.

10. A method for manufacturing an air-conditioning condensate drainage system for the roof structure of buildings, comprising:

(a) positioning a heat weldable isolation membrane for heat welding;

(b) assembling a pair of ridge defining elements in spaced relation on said isolation membrane;

(c) assembling at least one upper membrane in overlying relation with said ridge defining elements and at least a portion of said isolation membrane and with edge portions of said upper membrane in face-to-face contact with said isolation membrane; and (d) applying sufficient heat to said upper membrane and isolation membrane to cause heat welding thereof.

11. The method of claim 10, comprising:

during said heating step, applying mechanical pressure to said edge portions of said isolation membrane and said upper membrane for enhancing said heat welding.

12. The method of claim 10, comprising:

securing said ridge defining elements to said isolation membrane prior to said assembling said at least one upper membrane in overlying relation with said ridge defining elements and said isolation membrane.

13. The method of claim 10, wherein said assembling said at least one upper membrane in overlying relation with said ridge defining elements comprising:

(a) assembling a pair of upper membrane strips each having side edges in respective overlying relation with said ridge defining elements and positioning said upper membrane strips with said side edges disposed in contact with said isolation membrane; and (b) said step of applying sufficient heat causing heat welding of said side edges of said pair of upper membrane strips to said isolation membrane.

14. The method of claim 13, comprising:

applying mechanical pressure to said side edges of said pair of upper membrane strips and to said isolation membrane for enhancing heat welding thereof.

15. A method for installing an air-conditioning condensate drainage system on the roof structure of a building having one or more air-conditioning units, wherein the roof structure includes a roof membrane, said method comprising:

(a) affixing an elongate strip of isolation membrane to the roof membrane of the roof structure along a desired path from an air-conditioning unit to a roof drain; and (b) assembling a pair of ridge elements in spaced relation on said isolation membrane to define a roof mounted air-conditioning condensate drain channel, said pair of ridge elements each having sufficient height to provide for containment of the maximum expected flow of air-conditioning condensate within said air-conditioning condensate drain channel.

16. The method of claim 15, comprising:

(a) said affixing an elongate strip of isolation membrane to the roof membrane of the roof structure being fixing an elongate strip of built-up roofing material to the roof membrane; and (b) said assembling a pair of ridge elements being assembling a plurality of layers of strips of built-up roofing material to achieve said sufficient height and orienting opposing edges of said plurality of layers of strips to define opposed air-conditioning condensate containment walls of said air-conditioning condensate drain channel.

17. The method of claim 15, comprising:

(a) said affixing an elongate strip of isolation membrane to the roof membrane of the roof structure being fixing an elongate strip of heat weldable isolation membrane material to said roof membrane by heat welding thereof;

(b) locating a pair of ridge defining strips in spaced relation on said heat weldable isolation membrane;

(c) locating at least one upper membrane in overlying relation with said ridge defining strips and with at least edge portions of said at least one upper membrane disposed in contact with said isolation membrane; and (d) heat welding said at least edge portions of said at least one upper membrane to said isolation membrane, said ridge defining strips cooperating with said isolation membrane to define an air-conditioning condensate drain channel and elevating said at least one upper membrane along said ridge defining strips and forming spaced ridges of sufficient height for containment of the maximum expected volume of air-conditioning condensate flow within said air-conditioning condensate drain channel.

18. A method for manufacturing an air-conditioning condensate drainage system for the roof structure of buildings, comprising:

(a) positioning a chemically weldable isolation membrane for heat welding;

(b) assembling a pair of ridge defining elements in spaced relation on said isolation membrane;

(c) assembling at least one upper membrane in overlying relation with said ridge defining elements and at least a portion of said isolation membrane and with edge portions of said upper membrane in face-to-face contact with said isolation membrane; and (d) applying sufficient welding chemical to said upper membrane and isolation membrane to cause chemical welding thereof.

19. The method of claim 18, comprising:

applying mechanical pressure to said side edges of said pair of upper membrane strips and to said isolation membrane in the presence of said welding chemical for enhancing said chemical welding thereof.

* * * * *